US009862523B2

(12) United States Patent
Stuart et al.

(10) Patent No.: US 9,862,523 B2
(45) Date of Patent: Jan. 9, 2018

(54) CONTAINER SYSTEM WITH WALL SECTIONS, END CAPS, AND A ROLL SUPPORTING INSERT

(71) Applicant: Deflecto, LLC, Indianapolis, IN (US)

(72) Inventors: Christopher Stuart, Noblesville, IL (US); James DeChant, Carmel, IN (US); Cyril Bennett, Indianapolis, IN (US); Patrick Foley, Fishers, IN (US); Danielle Rodgers, Indianapolis, IN (US)

(73) Assignee: Deflecto, LLC, Indianapolis, IN (US)

( * ) Notice: Subject to any disclaimer, the term of this patent is extended or adjusted under 35 U.S.C. 154(b) by 0 days.

(21) Appl. No.: 14/852,922

(22) Filed: Sep. 14, 2015

(65) Prior Publication Data

US 2016/0075473 A1 Mar. 17, 2016

Related U.S. Application Data

(60) Provisional application No. 62/049,792, filed on Sep. 12, 2014.

(51) Int. Cl.

| | |
|---|---|
| ***B65D 21/08*** | (2006.01) |
| ***B65D 8/00*** | (2006.01) |
| ***B65D 25/06*** | (2006.01) |

(52) U.S. Cl.
CPC ..... *B65D 21/083* (2013.01); *B65D 11/02* (2013.01); *B65D 25/06* (2013.01)

(58) Field of Classification Search
CPC ... B56D 21/0228; B65D 21/083; B65D 21/08
USPC ..... 220/4.26; 206/407, 397, 391, 394
See application file for complete search history.

(56) References Cited

U.S. PATENT DOCUMENTS

| | | | | |
|---|---|---|---|---|
| 537,182 | A * | 4/1895 | Brown | H02G 3/185 220/3.7 |
| 816,959 | A * | 4/1906 | Briganti | A61L 2/26 206/210 |
| 2,326,414 | A * | 8/1943 | Thompson | B65D 7/00 206/503 |
| 4,273,392 | A * | 6/1981 | Stinson | A47K 10/22 206/394 |
| 5,671,856 | A * | 9/1997 | Lisch | A01K 97/06 206/519 |
| 6,116,439 | A * | 9/2000 | Yaniv | A61J 9/00 215/10 |
| 6,854,596 | B1 * | 2/2005 | Wiese | A47K 10/22 206/225 |
| 2003/0150857 | A1 * | 8/2003 | Tsai | B65D 21/0228 220/4.27 |
| 2004/0262306 | A1 * | 12/2004 | Smith | B65D 21/0228 220/4.26 |
| 2006/0108248 | A1 * | 5/2006 | Power | A47K 10/22 206/394 |

(Continued)

*Primary Examiner* — Stephen Castellano
(74) *Attorney, Agent, or Firm* — Dentons US LLP; Brian R. McGinley; Roman Tsibulevskiy

(57) ABSTRACT

A container system comprising a plurality of containers, each container comprising (a) a first end and a second end, each end defining an opening of the container and (b) a wall extending down from the first end to the second end so as to form a cavity within the container where least one of the plurality of containers can be removably mated with one or more containers to increase the internal volume of the container system.

18 Claims, 13 Drawing Sheets

(56) References Cited

U.S. PATENT DOCUMENTS

| | | | | |
|---|---|---|---|---|
| 2009/0080180 | A1* | 3/2009 | Bertken | A47G 19/2227 362/101 |
| 2012/0043295 | A1* | 2/2012 | Webster | B65D 47/06 215/44 |
| 2013/0092693 | A1* | 4/2013 | Brennan | B65D 25/04 220/500 |
| 2013/0111726 | A1* | 5/2013 | Krieger | B65D 21/022 29/428 |
| 2014/0238949 | A1* | 8/2014 | Patel | B65D 21/0228 215/6 |

* cited by examiner

Inside compartment

Outside lid

Inside lid

CONTAINER SYSTEM WITH WALL SECTIONS, END CAPS, AND A ROLL SUPPORTING INSERT

CROSS-REFERENCE TO RELATED APPLICATIONS

This application claims the benefit of the filing date of U.S. Provisional Application 62/049,792 entitled "Container System Apparatus and Method" filed on Sep. 12, 2014, all of which is incorporated herein by reference.

FIELD OF THE INVENTION

The present invention relates to a container system that includes containers configured to connect to each other via a corresponding end cap or a lip. Further, the individual containers can be combined to increase the cavity volume of the container system either by creating an increased continuous cavity or individual cavity compartments, or both.

BACKGROUND OF THE INVENTION

Storing items such as tape rolls and ribbon and other craft or office supply items can be difficult with the current storage systems. This is because known storage systems do not offer flexibility to vary the cavity volume of a storage container or easily stack storage containers together while maintaining individual compartments.

In an embodiment of the invention there is a container system comprising a plurality of containers, each container comprising (a) a first end and a second end, each end defining an opening of the container and (b) a wall extending down from the first end to the second end so as to form a cavity within the container. In the embodiment, at least one of the plurality of containers can be removably mated with one or more containers to increase the internal volume of the container system.

In another embodiment, the container system includes one or more end cap configured to removably attach to a first end and a second end of at least one of the containers. The end cap may comprise a group of more than one convex ridges on the outside perimeter of the end cap.

In another embodiment of the container system the first end of a container is configured to mate with the second end of another container.

In another embodiment of the invention, the first end of the end cap is configured to mate with the second end of a container.

In another embodiment of the invention the first end of each container is configured to mate with the second end of another container, a second end of an end cap, or both.

In another embodiment of the invention the container includes a removable insert including a cylindrical rod and a base.

In another embodiment of the invention each container includes a first end having a tab and a second end with a channel therein, where each tab is configured to fit within each channel.

In another embodiment of the invention the container system includes an end cap with a first end having a tab and a second end with a channel where each tab is configured to fit within a channel.

In another embodiment of the invention there is a container system kit comprising a plurality of containers, each container comprising (a) a first end and a second end, each end defining an opening of the container and (b) a wall extending down from the first end to the second end so as to form a cavity within the container and at least two end caps, where at least one of the plurality of containers can be mated with one or more containers to increase the internal volume of the container system and each end cap is configured to removably attach to a first end and a second end of at least one of the containers.

Another embodiment of the invention includes a method for creating a container system comprising the steps of providing a plurality of containers, each container comprising (a) a first end and a second end, each end defining an opening of the container and (b) a wall extending down from the first end to the second end so as to form a cavity within the container, each container configured to be mated with one or more containers to increase the internal volume of the container system, providing at least one end cap is configured to removably attach to a first end and a second end of at least one of the containers and selectively mating at least one container with at least one of an end cap and/or another container. Further, one or more containers can be mated together to create a continuous volume within the mated containers or an intervening end cap is used to mate one or more containers to create and individual container.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE INVENTION

Figure 1:
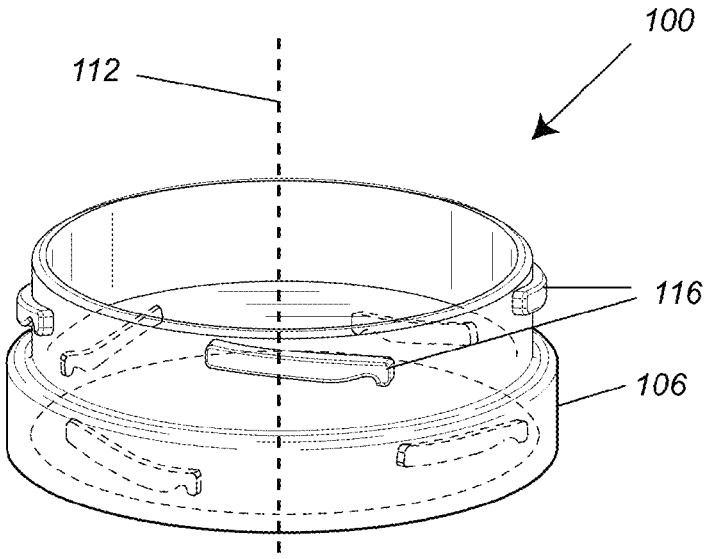
FIG. 1 depicts a front perspective of an embodiment of an end cap.
Figure 2:
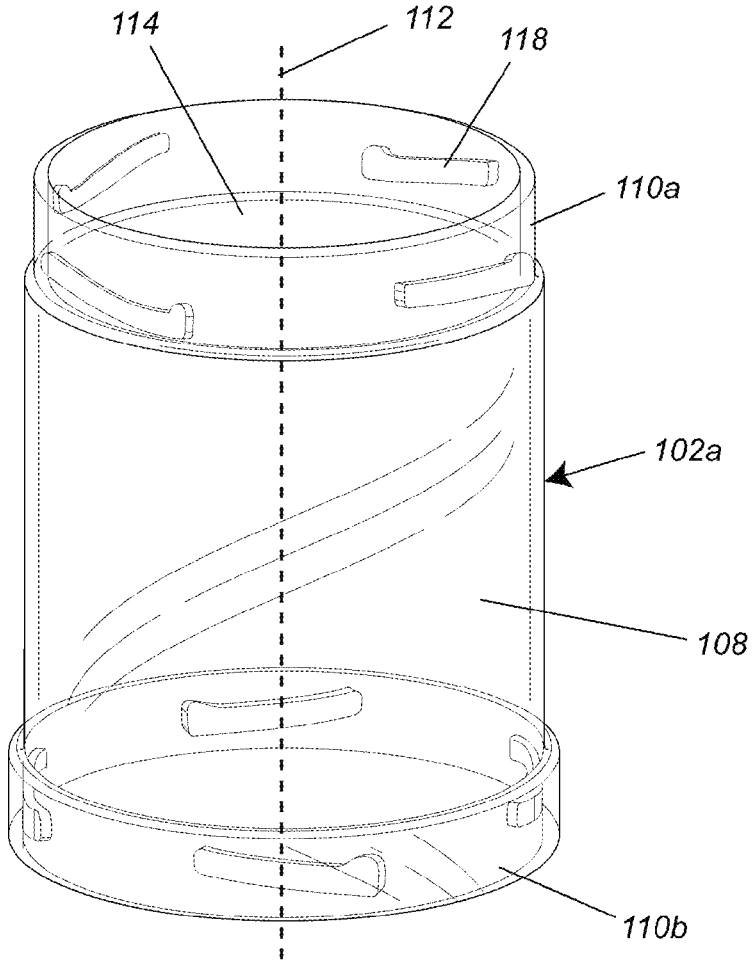
FIG. 2: depicts a front view of an embodiment of a container unit.
Figure 3:
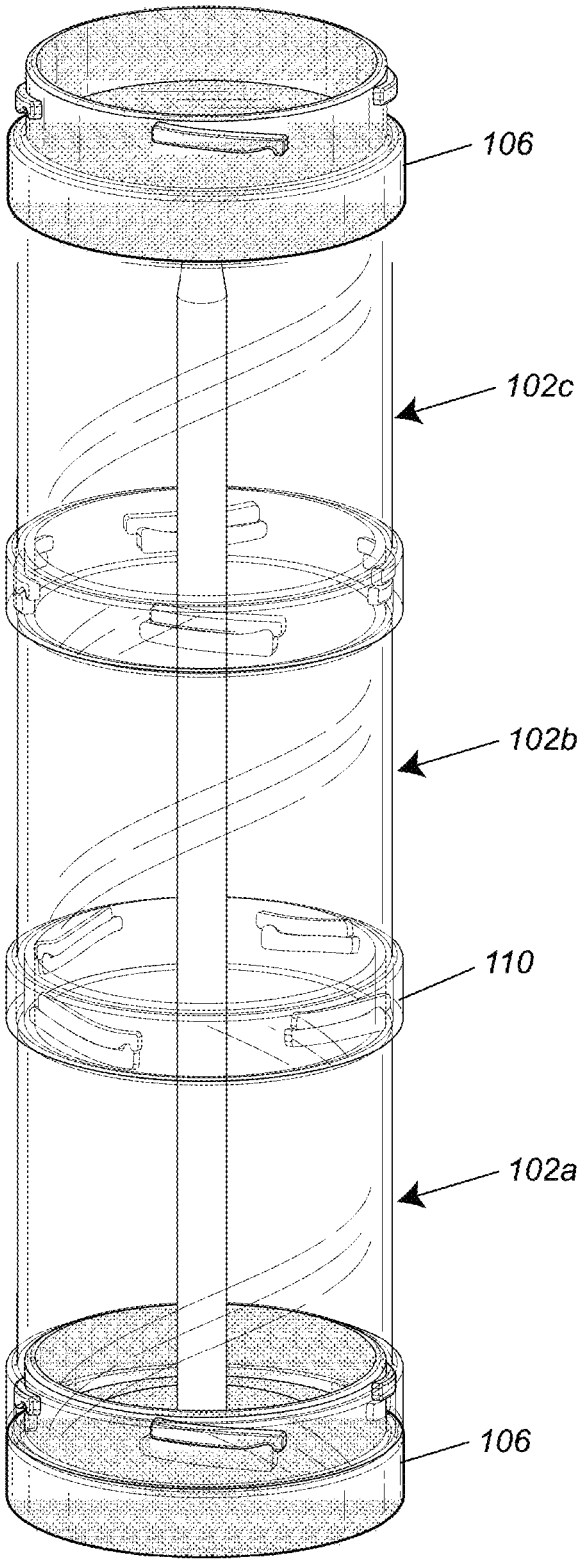
FIG. 3: depicts a front view of an embodiment of the container system.

As shown in FIGS. 1 and 2, the container system 100 of the present invention comprises at least one individual container 102-*a* which may be any receptacle in which material may be held or carried. Included with container 102-*a* may be end caps 106, walls 108, and lips 110. Planes that bisect each of base 106, walls 108, and an upper lip 110-*a* and a lower lip 110-*b* may intersect to define longitudinal axis 112 such that product 100 may be conceived to rotate uniformly about longitudinal axis 112. End cap 106 may serve as a base to support container 102 on a surface so that longitudinal axis 112 remains perpendicular to that surface, irrespective of the contents of container 102. The end cap 106 can be removable, whereby when the end cap is removed the container has openings at each end. Alternatively, end cap 106 may also serve as a removable lid for the container.

Walls 108 may extend from the upper lip 110-*a* to the lower lip 110-*b* so as to form cavity 114. Any item may be placed within cavity 114 for storage or transportation. To best store items of varying shapes, a cross section through longitudinal axis 112 of container 102-*a* may define a different perimeters such as triangle perimeter, an oval perimeter, a rectangular perimeter, a square perimeter or the like. Further to best store items of varying length, the container 102-*a* can be mated with one or more containers 102-*b*, 102-*c* to increase the internal volume of the cavity 114.

Lips 110-*a* and 110-*b* may be a projecting edge whose perimeter defines an opening in container 102-*a* to cavity 114. A lip is located at each end of the container 102-*a*, thereby causing the container 102-*a* to have an upper lip 110-*a* and a lower lip 110-*b*. The perimeter of lip 110 may circumscribe the perimeter of walls 108, coincide with the perimeter of walls 108, or be circumscribed by the perimeter of walls 108.

The features of lip 110 may be adapted to receive an end cap and/or serve as a mating area for another container 102-*b*. For example, the lip can include an external thread, 118 which is adapted to mate with a corresponding thread 116 on the end cap 106. The threads, 116 and 118 can be adapted such that the lip and the end cap can twist into place with varying degrees of rotation. For example, depending on the location of the threads, the end cap may lock into place with a quarter turn, or may require a 360 degree rotation. Alternatively, the lip and end cap can be configured such that the corresponding threads permit the end cap to snap into place on the lip.

Figure 4:
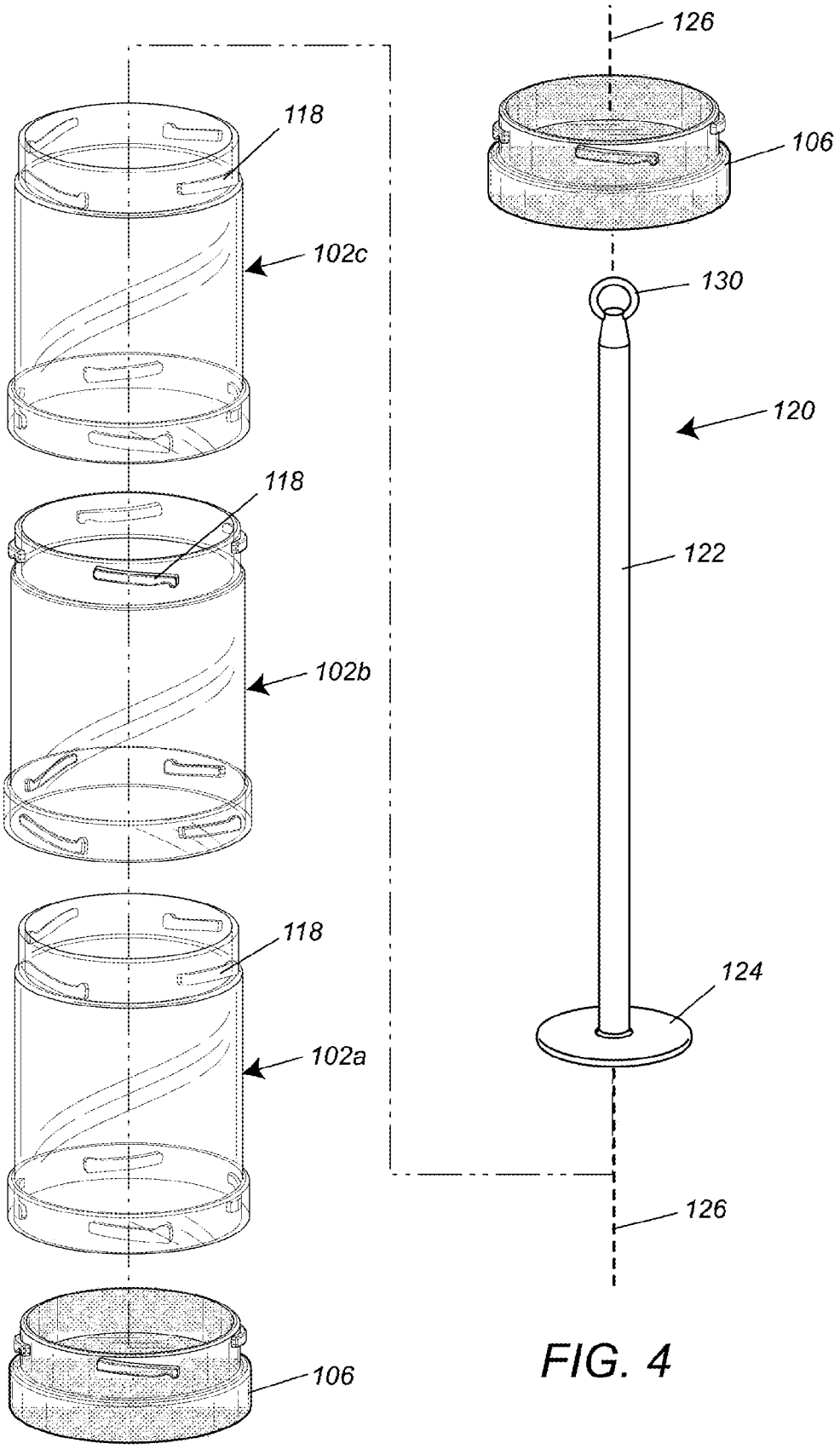
FIG. 4: depicts an exploded view of an embodiment of the container system.
Figure 5:
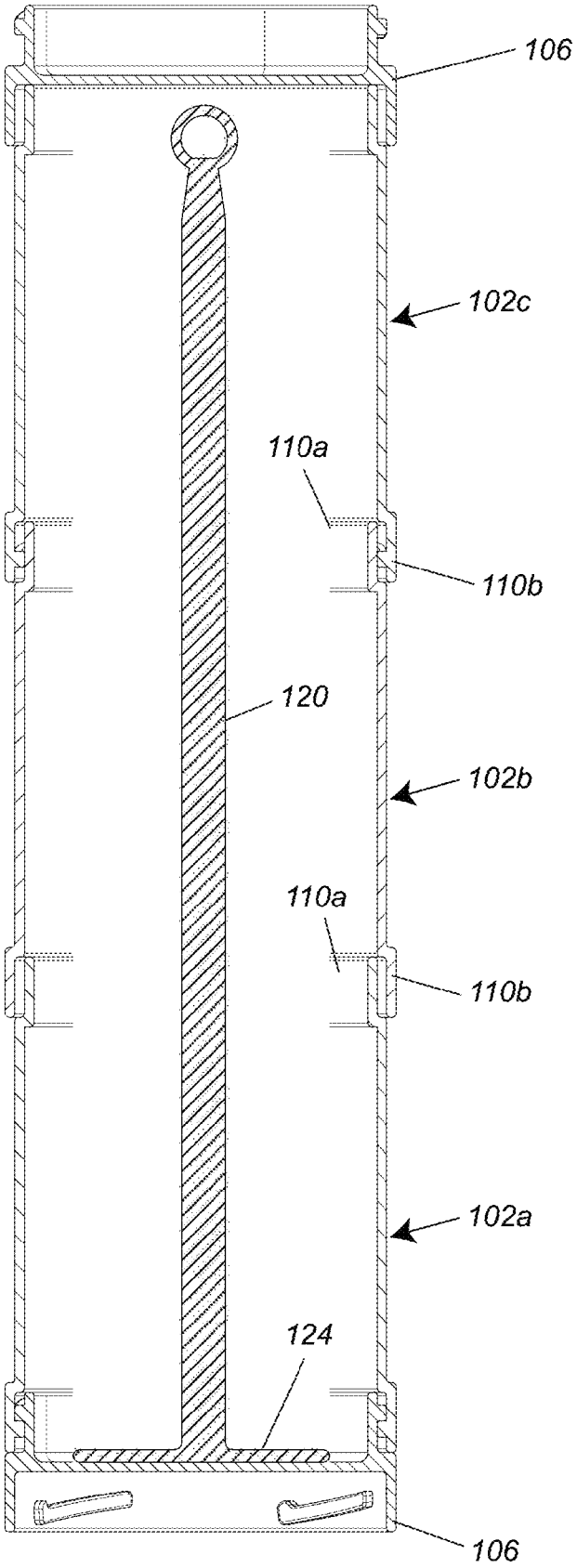
FIG. 5: depicts an embodiment of the container system.
Figure 6:
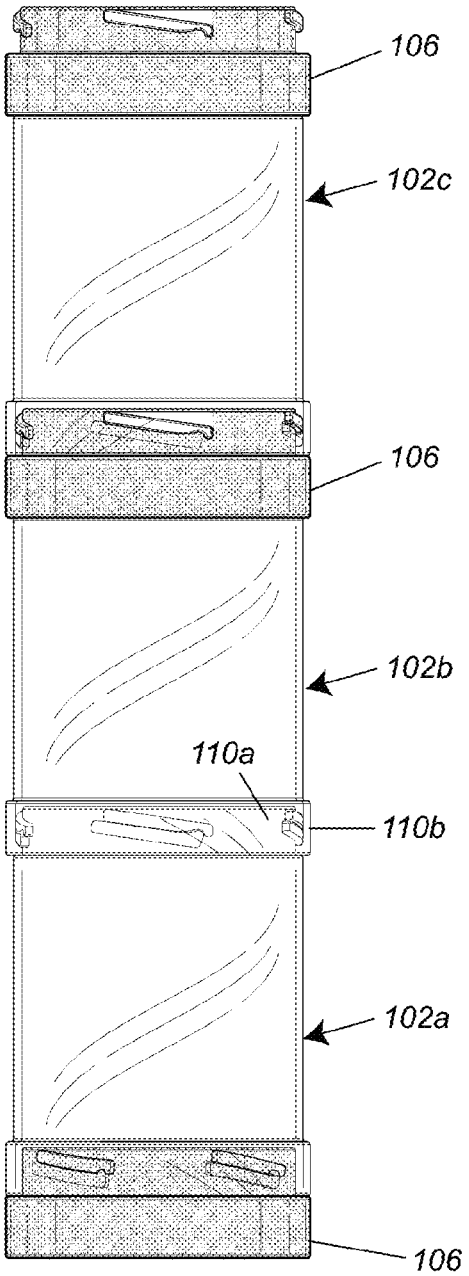
FIG. 6: depicts an embodiment of the container system.
Figure 7:
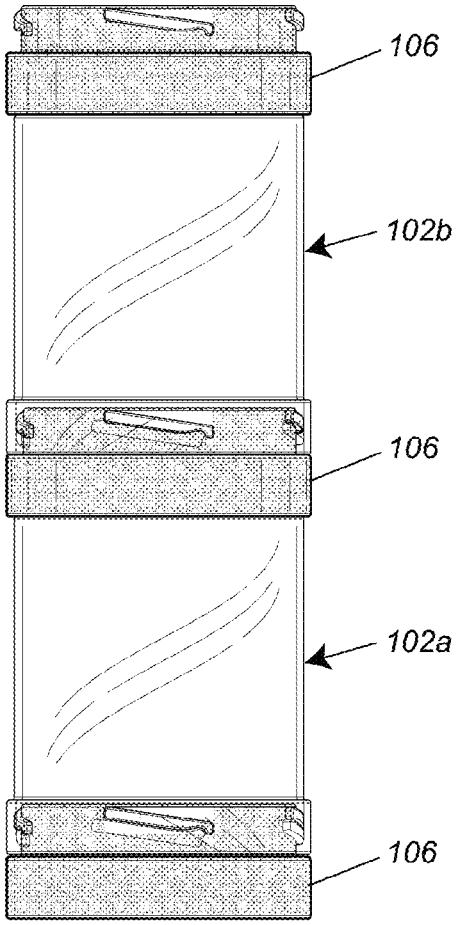
FIG. 7: depicts an embodiment of the container system.
Figure 8:
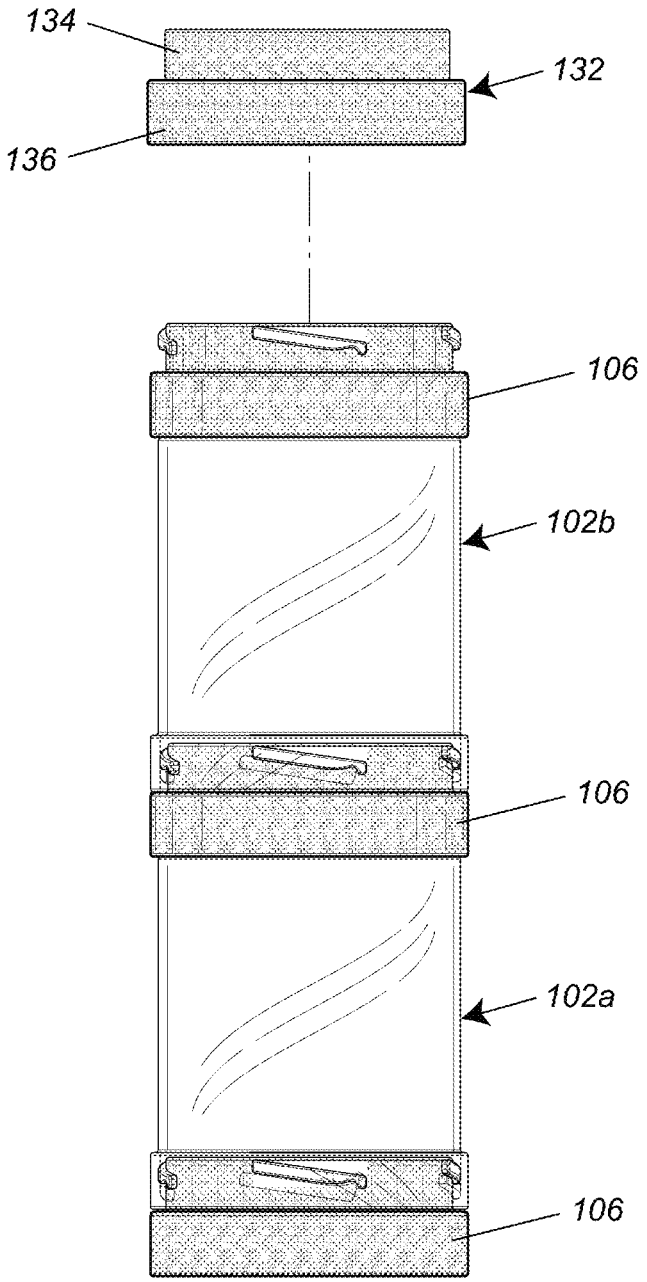
FIG. 8: depicts an embodiment of the container system.

Further, the lip 110 can be configured to mate with a lip 110 of another container without an endcap (FIG. 4). As such, because in an embodiment of the invention the containers are configured to mate with the lip of another container, a corresponding end cap, or both, the configurations of the container system are many and can include variations where all of the end caps are used to created individual compartments, no end caps are used to increase the continuous volume inside of the container system or a combination end-caps and no end-caps are used to create a container system with individual compartments and increased continuous volume as needed or desired. (FIGS. 6-8). For example, the container can have an end cap to create an individual unit which can mate with another container having an end cap or no end cap at all.

As shown in FIG. 2, a container 102-*a* may include a lip 110 on each end of the container, i.e. an upper lip 110-*a* and a lower lip 110-*b*. In this instance, an end cap can be mated with the lower lips of the container to form a base and an end cap can be mated with the upper lip of the container to form a cap and create a closed receptacle.

Alternatively, as shown in FIG. 4, the container 102-*a* can be mated with a lip 110 of the second container 102-*b* to increase the receptacle volume within the container and extend the length of the container. As shown in FIGS. 3-6 a third container 102-*c* can be mated with a second container 102-*b* via the corresponding threads on the lip of the third container. In this configuration the cavity within the container system 100 is continuous, and an end cap is located at the lower lip 110-*b* of container 102-*c* to form a base and the upper lip 110-*a* of the container 102-*a* to form a lid. A person of ordinary skill in the art would understand that the present invention is not limited to three containers mated together, and that fewer than three containers or more than three containers can be mated together in order to increase or decrease the receptacle volume within the container and extend the length of the container as needed.

Further, because the end cap 106 can also be used as a lid, individual compartments can be created within the container system 100 to store different objects. As shown in FIG. 7, an end cap 106 is mated with the each lip of the containers 102-*a* and 102-*b c* creating a base and a cap for each container and an individual compartment within the container system. Specifically, in this embodiment, the container system 100 includes two individual compartments 102-*a*, and 102-*b* defined by the an end cap 106 mated with each lip 110 and walls 108. A person of ordinary skill in the art would understand that the container system 100 is not limited to a configuration where all of the containers have an end cap on each lip, creating three individual compartments within the container system 100.

For example, in FIG. 6, container 102-*c* can include an end cap on the upper and lower lips of the container creating an individual compartment that can be mated with containers 102-*b* and 102-*a* mated in a configuration that allows for a continuous cavity space between containers 102-*b* and 102-*c*. In this configuration, the container system would include a shorter container 102-*c* and an longer container with an increased cavity volume and length created by mating containers 102-*b* and 102-*a* without an intervening end cap.

When the cavity within the container system 100 is continuous, an insert 120 as shown in FIG. 4 can be removably placed within the container. The insert 120 includes a cylindrical rod 122 and a base 124. Planes that bisect each of base 124 and the cylindrical rod 122 may intersect to define longitudinal axis 126 such that cylindrical rod may be conceived to rotate uniformly about longitudinal axis 126. Base 124 may serve to support the cylindrical rod 122 on a surface so that longitudinal axis 126 remains perpendicular to that surface. The cylindrical rod 122 can be one continuous piece or can telescopically adjust to increase or decrease the length of the cylindrical rod to fit within the container system 100. Additionally, the cylindrical rod can include individual pieces of varying lengths that can removably attach to each other to increase or decrease the length of the cylindrical rod.

The cylindrical rod can have a diameter that is suitable to hold various objects defined by a tube. For instance, rolls or ribbon or tape can be stacked on top the base and each other to form a stack that is held in place by the cylindrical rod. The rod is not limited to a cylinder shape, but can be adapted, like the container to have a perimeter that meets a corresponding perimeter of the object to be stored on the rod, i.e. a square, oval, rectangular or triangular shaped rod could be employed. Further a handle, ring or other suitable means 130 to aid in inserting and removing the insert 120 can be placed at the end opposite of the base 124.

FIG. 8 shows an embodiment of an alternative end cap 132. In this instance the end cap 132 is configured to mate with only one container lip 110, end cap 106 or both. Specifically, this alternative end cap has a lower portion 136 that is configured to mate with the lip 110, end cap, or both of another container, 102-*b* and an upper portion 134 that is not configured to mate with an end cap or lip of another unit. The upper portion 134 thereby is a lid that prevents further connecting or mating between containers. This may allow different container systems to be easily stacked on each other or to create multiple individual containers that are not connected to each other with an effective lid.

A mounting system may be provided to one or more of the containers to allow the container system 100 to be mounted to a wall or other surface. Such a mounting system would enable the container system to be placed on a wall or more securely fastened to an underlying surface such as a table or shelf.

The container system can also be sold as a kit that includes three or more individual containers and an end cap for each lip. Such a kit would allow a person to create varying configurations of the container system where an continuous cavity is created by mating all the individual containers together, or creating one or more individual compartments within the container system by mating an end cap to in-between individual containers that are connected or mated together.

Figure 9:
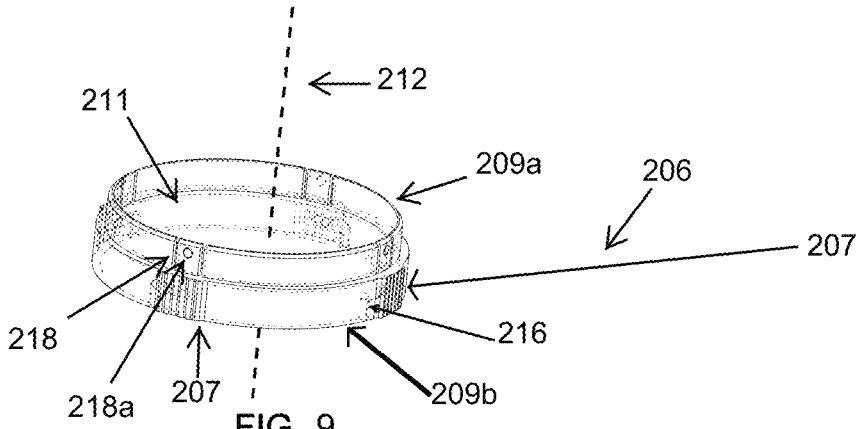
FIG. 9: depicts a front perspective of an embodiment of an end cap.
Figure 10:
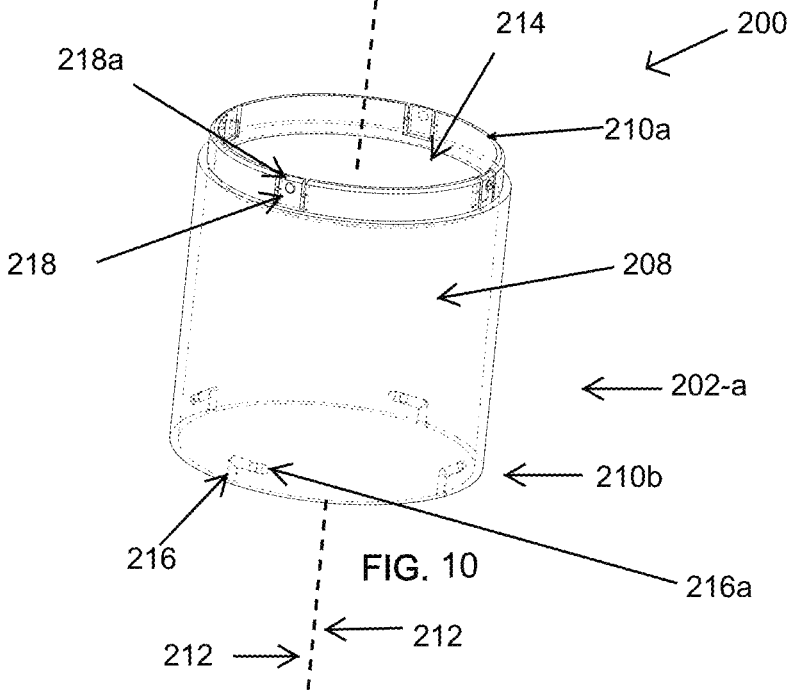
FIG. 10: depicts an front perspective of an embodiment a container unit.

FIGS. 9 and 10 show another embodiment the container system 200 of the present invention comprises at least one individual container 202-*a* which may be any receptacle in which material may be held or carried. Included with container 202-*a* may be end caps 206, walls 208, a first end 210-*a* and a second end 210-*b*. Planes that bisect each of base 206, walls 208, and the first and second ends 210-*a* and 210-*b* may intersect to define longitudinal axis 212 such that product 200 may be conceived to rotate uniformly about longitudinal axis 212.

As shown in FIG. 9, the end cap 206 may serve as a base to support container 202 on a surface so that longitudinal axis 212 remains perpendicular to that surface, irrespective of the contents of container 202. The end cap 206 can be removable, whereby when the end cap is removed the container has openings at each end. Alternatively, end cap 206 may also serve as a removable lid for the container. The end cap 206 has a first end 209-*a* and a second end 209-*b*. The first and second ends 209-*a* and 209-*b* may be a projected edge whose perimeter defines a surface 211 of the end cap. A lip is located at the first end 209-*a* of the end cap 206, thereby causing the end cap to have a first end with an upper lip 209-*a*. The perimeter of lip 209-*a* on the first end may circumscribe the perimeter of the surface 211, coincide with the perimeter of the surface 211 and extend upwards or downward therefrom, or be circumscribed by the perimeter of the surface 211. The second end 209-*b* may be an edge that circumscribes the perimeter of the surface 211, coincides with the perimeter of the surface and extend upwards or downward therefrom, or be circumscribed by the perimeter of the surface.

The features of the first and second ends 209-*a* and 209-*b* of the end cap may be adapted to receive another end cap and/or serve as a mating area for another container. For example, the first end 209-*a* can an include one or more tabs 218 which are each adapted to mate with a corresponding channel 216 located in an interior wall of the end cap at the second end 209-*b* of another end cap 206 or corresponding channel 216 located at the second end 210-*b* of a container. In an embodiment, the tab 218 can be integral with the first end 209-*a*. Further in an embodiment, the tab 218 can include a protrusion 218-*a* which extends outward from the tab 218. The shape of the protrusion 218-*a* corresponds to the shape of the channel 216 of the second end of the end cap 206 and the second end 210-*b* of a container 202. In either of the above described embodiments, the first end can include 1, 2, 3, 4, 5 or 6 tabs and the second end includes a number of channels corresponding to the number of tabs located on the first end, e.g. 1, 2, 3, 4, 5 or 6 channels.

In an embodiment, the endcap can also include a convex ridges 207 along the side edge of the end cap to facilitate placing the end cap on the container and removing the end cap from the container. In an embodiment adjacent convex ridges can form a group consisting of 3 to 10 convex ridges, both inclusive, in an embodiment the group can consist of 3 convex ridges, 4 convex ridges, 5 convex ridges, 6 convex ridges, 7 convex ridges, 8 convex ridges, 9 convex ridges or 10 convex ridges. Preferably, the convex ridges are spaced in a manner such that the width of the group of adjacent ridges is from 0.25 to 1.5 inches, both inclusive. In an embodiment, a plurality of groups of convex ridges can be equally spaced along the perimeter of the end cap. In an embodiment 2 groups of convex ridges, 3 groups of convex ridges or 4 groups of convex ridges can be equally spaced along the perimeter of the end cap. In the above mentioned embodiment, each group can include 3 convex ridges, 4 convex ridges, 5 convex ridges, 6 convex ridges, 7 convex ridges, 8 convex ridges, 9 convex ridges or 10 convex ridges.

Figure 11:
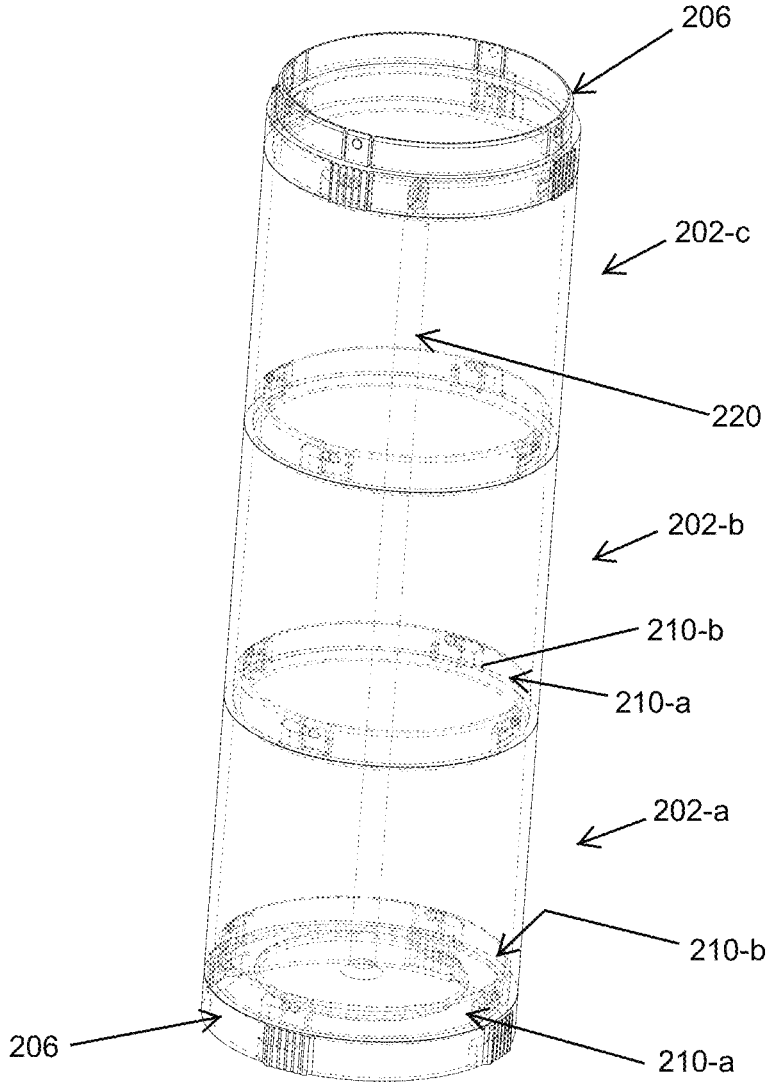
FIG. 11: depicts a front view of an embodiment of the container system.

In FIG. 10, which shows a container 202-*a* according to an embodiment, walls 208 may extend from the first end 210-*a* to the second end 210-*b* so as to form cavity 214. Any item may be placed within cavity 214 for storage or transportation. To best store items of varying shapes, a cross section through longitudinal axis 212 of container 202-*a* may define a different perimeters such as triangle perimeter, an oval perimeter, a rectangular perimeter, a square perimeter or the like. Further, to best store items of varying length, the container 202 can be mated with one or more containers as shown in FIG. 11 to increase the internal volume of the cavity 214.

The first and second ends 210-*a* and 210-*b* may be a projected edge whose perimeter defines an opening in the container 202 to a cavity 214. A lip is located at the first end 210-*a* of the container 202, thereby causing the container 202 to have a first end with an upper lip 210-*a*. The perimeter of lip 210-*a* on the first end may circumscribe the perimeter of walls 208, coincide with the perimeter of walls 208, or be circumscribed by the perimeter of walls 208. The second end 210-*b* may be an edge that circumscribes the perimeter of walls 208, coincides with the perimeter of walls 208, or be circumscribed by the perimeter of walls 208.

The features of the first and second ends 210-*a* and 210-*b* may be adapted to receive an end cap and/or serve as a mating area for another container. For example, the first end can include one or more tabs 218 which are each adapted to mate with a corresponding channel 216 on the end cap 206 or corresponding channel 216 located in an interior wall of the container at the second end 210-*b*. In an embodiment, the tab 218 can be integral with the first end 210-*a*. Further in an embodiment, the tab 218 can include a protrusion 218-*a* which extends outward from the tab 218. The shape of the protrusion corresponds to the shape of the channel 216 located in an interior wall of the end cap 206 and the channel 216 on an end cap 206. In either of the above described embodiments, the first end can include 1, 2, 3, 4, 5 or 6 tabs and the second end includes a number of channels corresponding to the number of tabs located on the first end, e.g. 1, 2, 3, 4, 5 or 6 channels.

The tab 218 and channel 216 in each of the end cap and container can be adapted such that the first end of the container and the first end of the end cap can be mated with the second end of another container, the second end of an end cap, or both. In particular the two components being mated can twist into place with varying degrees of rotation. For example, depending on the location of the tab 218 and channel 216, the first end of the end cap may lock into place with the channel within second end of another container or the channel within second end of another end cap with a quarter turn, or may require a 360 degree rotation. Likewise the same type of rotation may be needed if two containers are mated together without an intervening end cap.

Alternatively, the first end of the container and the first end of the end cap can be configured such that the corresponding tab 218 and channel 216 located on either another end cap or another container can snap into place. In an embodiment, the end cap is pushed into the container so that the sides of the end cap slide closely along the interior peripheral wall of the second end until the protrusion 218-*a* encounters a channel 216 within the interior peripheral wall of the second end. The end cap is then maneuvered so that the protrusion slides into place within the channel. In an embodiment, the channel can be a vertical channel, a horizontal channel, a V-shaped channel (positioned either horizontally or vertically) or an L-shaped channel (positioned either horizontally or vertically). Depending on the shape of the channel, the end cap may require vertical movement, horizontal movement or a combination of both to engage with the second end of the channel. Further, an end portion of the channel 216 can be provided with a protrusion 216-*a* that extends outwardly from the channel in order to more securely attach the lid in place. In this embodiment, the continued advancement of the protrusion 218-*a* within the channel 216 requires the tab 218 to be pushed inwardly so that the protrusion 218-*a* on the tab slides over the protrusion 216-*a* in the channel until the protrusion 216-*a* reaches the end of the channel 216. In this embodiment, the protrusion 216-*a* and protrusion 218-*a* are adjacent to each other. To disengage the end cap from the second end, the end cap is maneuvered so that the protrusion slides out of place from the channel 216. In the embodiment where the channel includes a protrusion 216-*a*, the tab 218 may be pushed inwardly so that the protrusion 218-*a* slides over the protrusion 216-*a* and the end cap is maneuvered to slide out from the channel 216.

Further, the first end 210-*a* can be configured to mate with a second end 210-*b* of another container without an end cap (FIG. 11). In an embodiment, the first end of a first container 202-*a* is pushed into the second end of a second container 202-*b* so that the sides of the first end slide closely along the interior peripheral wall of the second end until the protrusion 218-*a* encounters a channel 216 within the interior peripheral wall of the second end. The first end is then maneuvered so that the tab or the tab with a protrusion slides into place within the channel. In an embodiment, the channel can be a vertical channel, a horizontal channel, a V-shaped channel (positioned either horizontally or vertically) or an L-shaped channel (positioned either horizontally or vertically). Depending on the shape of the channel, the first end of a first container 202-*a* may require vertical movement, horizontal movement or a combination of both to engage with the second end of the second container 202-*b*. Further, an end portion of the channel 216 can be provided with a protrusion 216-*a* that extends outwardly from the channel in order to more securely attach the lid in place. In this embodiment, the continued advancement of the protrusion 218-*a* within the channel 216 requires the tab 218 to be pushed inwardly so that the protrusion 218-*a* on the tab slides over the protrusion 216-*a* in the channel until the protrusion 216-*a* reaches the end of the channel 216. In this embodiment, the protrusion 216-*a* and protrusion 218-*a* are adjacent to each other. To disengage the end cap from the second end, the end cap is maneuvered so that the protrusion slides out of place from the channel 216. In the embodiment where the channel includes a protrusion 216-*a*, the tab 218 may be pushed inwardly so that the protrusion 218-*a* slides over the protrusion 216-*a* and the end cap is maneuvered to slide out from the channel 216.

As such, because in an embodiment of the invention the second end of a container is configured to mate with the first end of another container, a first end of an end cap, or both, and the second end of an end cap is configured to mate with the first end of a container, a first end of another container, or both the configurations of the container system are many and can include variations where all of the end caps are used to created individual compartments, no end caps are used to increase the continuous volume inside of the container system or a combination end-caps and no end-caps are used to create a container system with individual compartments and increased continuous volume as needed or desired. (FIGS. 13-18). For example, the container can have an end cap to create an individual unit which can mate with another container having an end cap or no end cap at all.

As shown in FIG. 11, a container 202-*a* may include a first end 210-*a* and a second 210-*b*. In this instance, the first end of an end cap 206 can be mated with the second end 210-*b* of the first container 202-*a* to form a base and second end of another end cap 202-*c* cap 202 can be mated with the first end 210-*a* of the uppermost container 202-*c* to form a cap and create a closed receptacle. As shown here, one or more intervening containers 202-*b* can be mated between the lowermost container 202-*a* and the uppermost container 202-*c*.

Figure 13:
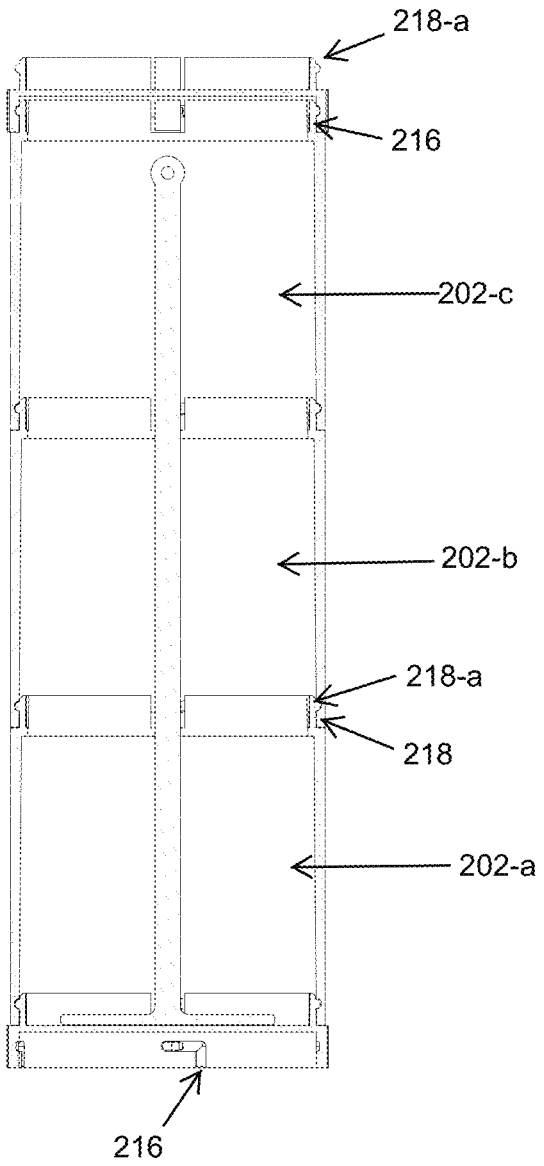
FIG. 13: depicts a front view of an embodiment of the container system.
Figure 14:
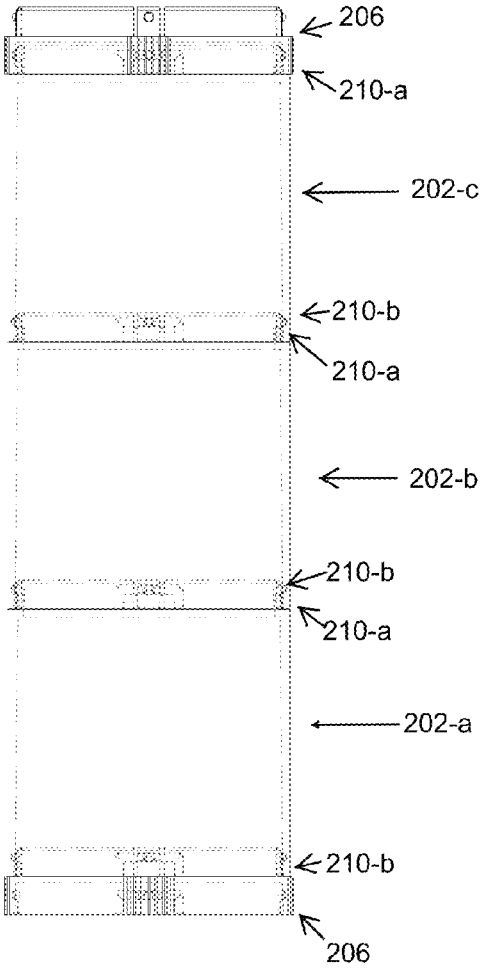
FIG. 14: depicts a front view of an embodiment of the container system.
Figure 15:
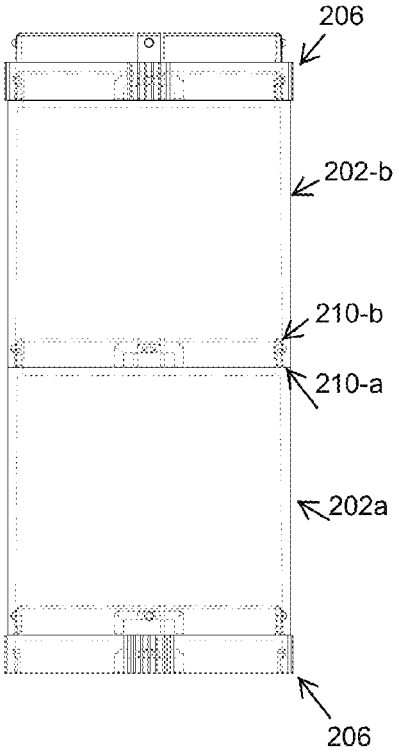
FIG. 15: depicts a front view of an embodiment of the container system.

Alternatively, as shown in FIG. 15, the first end 210-*a* of container 202-*a* can be mated with the second end 210-*b* of a second container 202-*b* to increase the receptacle volume within the container and extend the length of the container. As shown in FIGS. 13 and 14 a third container 202-*c* can be mated with a second container 202-*b* via the second end of the third container and the first end of the second container. In this configuration the cavity within the container system 200 is continuous, and an end cap is located at the second end 210-*b* of container 202-*a* to form a base and first end 210-*a* of the third container 202-*c* to form a lid. A person of ordinary skill in the art would understand that the present invention is not limited to three containers mated together, and that fewer than three containers or more than three containers can be mated together in order to increase or decrease the receptacle volume within the container and extend the length of the container as needed. Further the containers can be separated with end caps to create one or more separate container units attached (and detachable from each other) to each other within the same system. The separate container units can comprise one or more containers to increase the continuos volume within a separate container.

Further, because the end cap 206 can also be used as a lid, individual compartments can be created within the container system 200 to store different objects. Similar to FIGS. 6 and 7, an end cap 206 is mated with second end of the first container 202-*a* creating a base. Further, in this embodiment the first end of the first container is mated with the second end of a second container 202-*b* to create a container with increased continuous cavity volume. In another embodiment, the first and second containers can be mated with an end cap thereby creating a container system 200 that includes two individual compartments 202-*a*, and 202-*b* defined by an end cap 206 mated with the corresponding end of a container. A person of ordinary skill in the art would understand that the container system 200 is not limited to a configuration where all of the containers have an end cap on each lip, creating three individual compartments within the container system 200.

Figure 16:
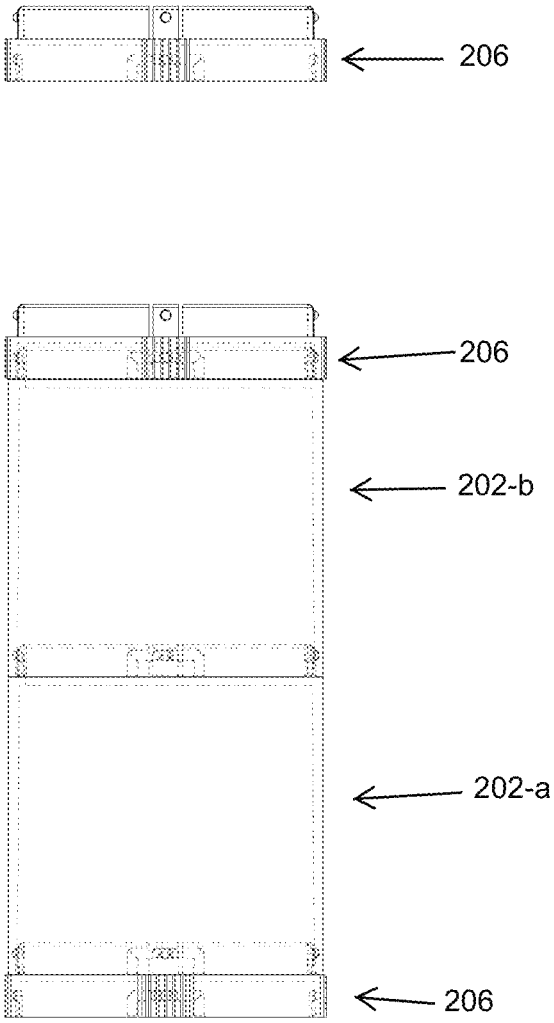
FIG. 16: depicts a front view of an embodiment of the container system.

FIG. 16 shows a container 202-*b* with an end cap 206 on the first end of a second container 202-*b*. The second end of the second container can be mated with the first end of a first container 202-*a* thereby creating a configuration of increased continuous cavity space between containers 202-*b* and 202-*a*. Further, an end cap can be used in-between containers to create one or more individual compartments within a container system. For example containers 202-*b* and 202-*a* can be mated in a configuration that allows for a continuous cavity space between containers 202-*b* and 202-*a* or an end cap can mate the first container 202-*a* with the second container 202-*b*. In this configuration, the container system would include a shorter container 202-*b* and 202-*a* in a continuous system. The containers 202-*b* and 202-*a* can attach detach from each other.

Figure 12:
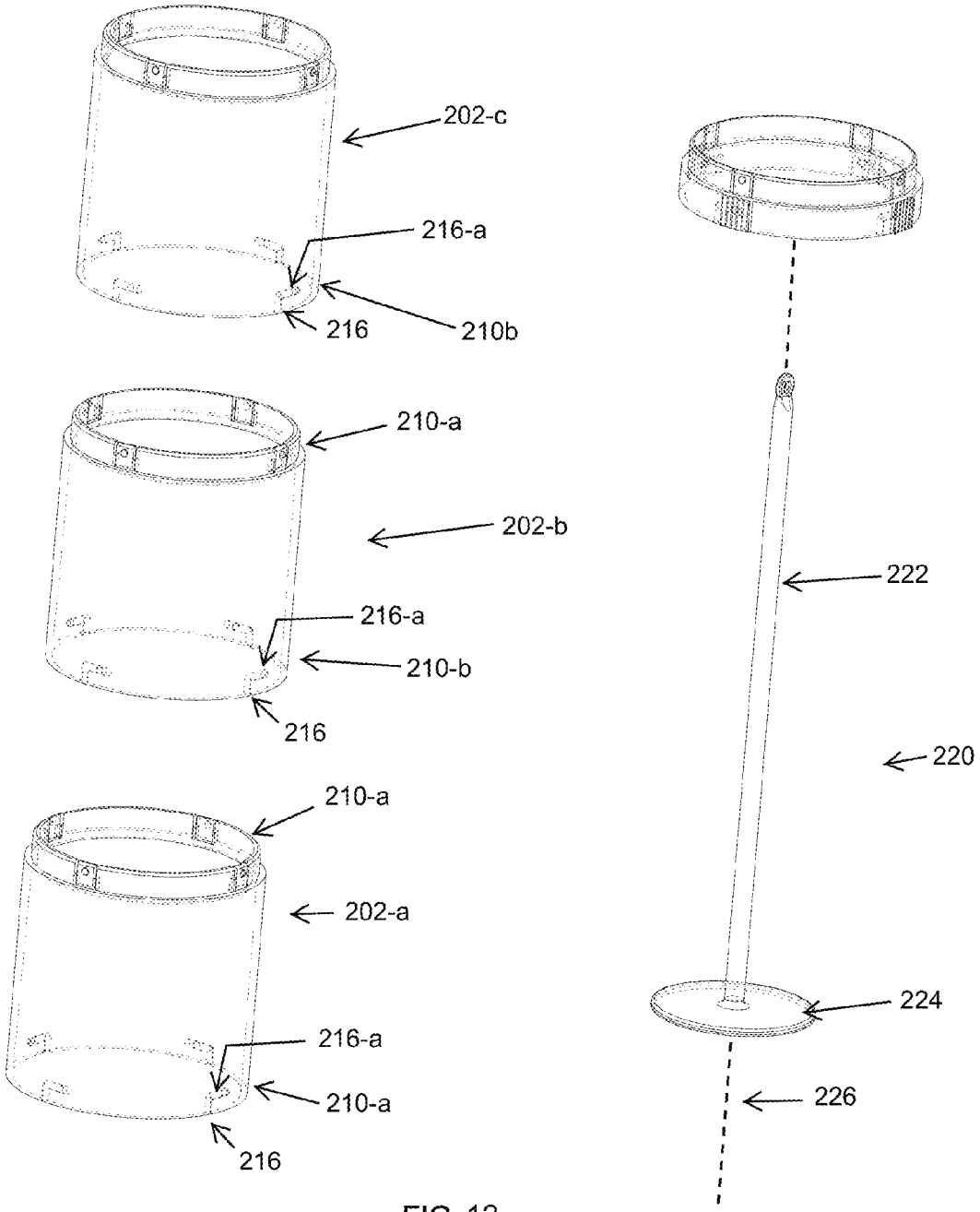
FIG. 12: depicts an exploded view of an embodiment of the container system.

When the cavity within the container system 200 is continuous, an insert 220 as shown in FIGS. 11 and 12 can be removably placed within the container. The insert 220 includes a cylindrical rod 222 and a base 224. Planes that bisect each of base 224 and the cylindrical rod 226 may intersect to define longitudinal axis 226 such that cylindrical rod may be conceived to rotate uniformly about longitudinal axis 226. Base 224 may serve to support the cylindrical rod 222 on a surface so that longitudinal axis 226 remains perpendicular to that surface. The cylindrical rod 222 can be one continuous piece or can telescopically adjust to increase or decrease the length of the cylindrical rod to fit within the container system 200. Additionally, the cylindrical rod can include individual pieces of varying lengths that can removably attach to each other to increase or decrease the length of the cylindrical rod.

Figure 18:
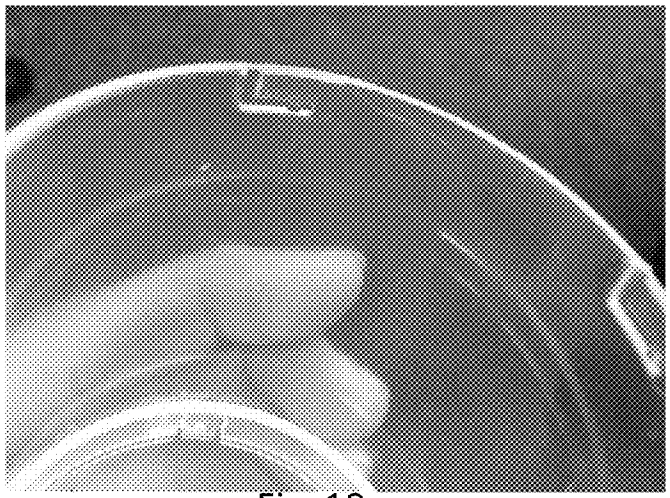
FIG. 18: depicts a detailed view of a portion of a container unit as shown in FIG. 10.
Figure 20:
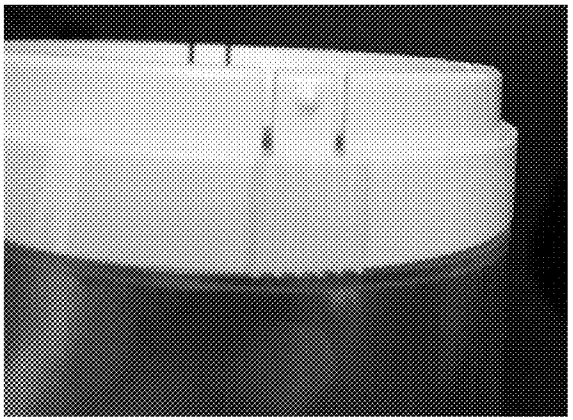
FIG. 20: depicts a detailed view of an embodiment of the end cap.
Figure 17:
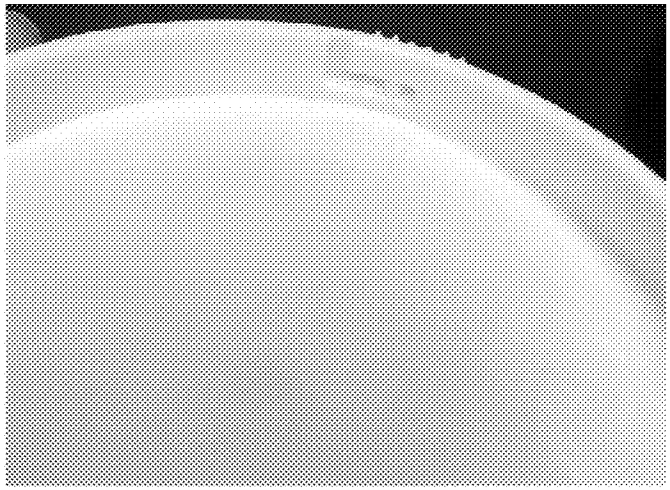
FIG. 17: depicts a detailed view of a portion of an end cap as shown in FIG. 9.
Figure 19:
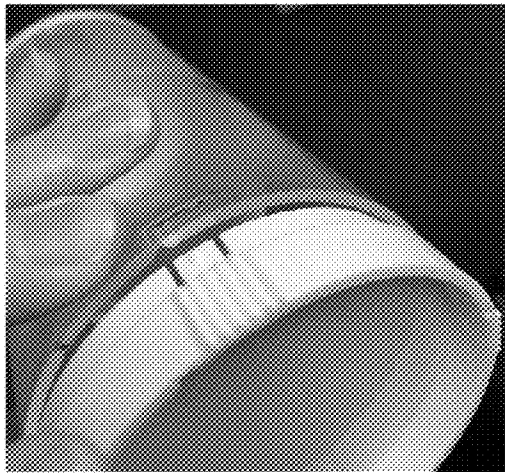
FIG. 19: depicts an exploded view an embodiment of the container system.

FIGS. 17-20 depict more detailed images of the end cap and the unit. Specifically, FIG. 17 show the channel within the second end of the end cap while FIG. 18 shows the channel within the second end of the container. FIG. 19 depicts a more detailed view of the end cap being maneuvered into place within a corresponding channel of a container. FIG. 20 depicts a more detailed view of the first end of the end cap.

The cylindrical rod can have a diameter that is suitable to hold various objects defined by a tube. For instance, rolls or ribbon or tape can be stacked on top the base and each other to form a stack that is held in place by the cylindrical rod. The rod is not limited to a cylinder shape, but can be adapted, like the container to have a perimeter that meets a corresponding perimeter of the object to be stored on the rod, i.e. a square, oval, rectangular or triangular shaped rod could be employed. Further a handle, ring or other suitable means 230 to aid in inserting and removing the insert 220 can be placed at the end opposite of the base 224.

A mounting system may be provided to one or more of the containers to allow the container system 200 to be mounted to a wall or other surface. Such a mounting system would enable the container system to be placed on a wall or more securely fastened to an underlying surface such as a table or shelf.

The container system can also be sold as a kit that includes three or more individual containers and an end cap for each lip. Such a kit would allow a person to create varying configurations of the container system where an continuous cavity is created by mating all the individual containers together, or creating one or more individual compartments within the container system by mating an end cap to in-between individual containers that are connected or mated together.

While various embodiments of the present invention have been described, it will be apparent to those of skill in the art that many more embodiments and implementations are possible that are within the scope of this invention. Accordingly, the present invention is not to be restricted except in light of the attached claims and their equivalents.

The invention claimed is:

1. A container system comprising:

a plurality of containers, each of the containers comprising (a) a first end and a second end, each of the ends defining an opening of the respective container, and (b) a wall extending down from the first end to the second end so as to form a cavity within the respective container, wherein the wall includes a transparent portion, wherein each of the containers includes an internal interruptedly threaded portion and an external interruptedly threaded portion, wherein the internal interruptedly threaded portion and the external interruptedly threaded portion are on the ends of the respective container that oppose each other, wherein the containers can be removably mated via interrupted threading directly with each other at the ends such that the cavities are in fluid communication with each other and thereby increase the internal volume of the container system;

an end cap coupled to at least one of the containers;

a removable insert including a rod, wherein the rod extends through the cavities simultaneously, wherein the rod includes a first end portion and a second end portion, wherein the first end portion includes a ring, wherein the second end portion includes a base resting on the end cap; and a roll of material mounted onto the rod between the first end portion and the second end portion.

2. The container system according to claim 1 further comprising a first end cap configured to removably attach to a first end and a second end of at least one of the containers.

3. The container system according to claim 2 further comprising a second end cap configured to removably attach to a first end and a second end of at least one of the containers.

4. The container system according to claim 1 wherein the first end of a container is configured to mate with the second end of another container.

5. The container system according to claim 2 wherein the first end of the end cap is configured to mate with the second end of a container.

6. The container system according to claim 1 wherein the first end of each container is configured to mate with the second end of another container, a second end of an end cap, or both.

7. The container system according to claim 1, wherein the rod is longitudinally adjustable.

8. The container system according to claim 1 wherein each container includes a first end having a tab and a second end with a channel therein, wherein each tab is configured to fit within each channel.

9. The container system according to claim 2, further comprising a first end having a tab and a second end with a channel therein, wherein each tab is configured to fit with each channel.

10. The container system according to claim 2, further comprising a group of more than one convex ridges on the outside perimeter of the end cap.

11. The container system of claim 1, wherein the roll of material is visible on the rod through the transparent portion.

12. The container system of claim 1, wherein the end cap is coupled to at least one of the containers via interrupted threading.

13. A method for creating a container system, the method comprising:

providing a plurality of containers, each of the containers comprising (a) a first end and a second end, each of the ends defining an opening of the respective container, and (b) a wall extending down from the first end to the second end so as to form a cavity within the respective container, wherein each of the containers includes an internal interruptedly threaded portion and an external interruptedly threaded portion, wherein the internal interruptedly threaded portion and the external interruptedly threaded portion are on the ends of the respective container that oppose each other, the containers configured to be mated via interrupted threading directly with each other at the ends such that the cavities are in fluid communication with each other and thereby increase the internal volume of the container system, wherein the wall includes a transparent portion;

providing a removable insert including a rod, wherein the rod extends through the cavities simultaneously;

mounting a roll of material onto the rod such that the roll of material is visible on the rod through the transparent portion;

providing at least one end cap configured to removably attach to a first end and a second end of at least one of the containers, wherein the at least one end cap supports the rod; and selectively mating at least one container with at least one of an end cap or another container via interrupted threading.

14. The method according to claim 13 wherein one or more containers can be mated together to create a continuous volume within the mated containers.

15. The method of claim 13, wherein the rod includes a first end portion and a second end portion, wherein the first end portion includes a ring, wherein the second end portion includes a base resting on the at least one end cap, wherein the roll of material is mounted onto the rod between the first end portion and the second end portion.

16. The method of claim 13, wherein the at least one end cap is configured to removably attach to the first end and the second end of at least one of the containers via interrupted threading.

17. A container system kit comprising:

a plurality of containers, each of the containers comprising (a) a first end and a second end, each of the ends defining an opening of the respective container, and (b) a wall extending down from the first end to the second end so as to form a cavity within the container, wherein the wall includes a transparent portion, wherein each of the containers includes an internal interruptedly threaded portion and an external interruptedly threaded portion, wherein the internal interruptedly threaded portion and the external interruptedly threaded portion are on the ends of the respective container that oppose each other; and at least two end caps, wherein, the containers can be mated via interrupted threading directly with each other at the ends such that the cavities are in fluid communication with each other and thereby increase the internal volume of the container system;

a removable insert including a rod, wherein the rod extends through the cavities simultaneously, wherein the rod includes a first end portion and a second end portion, wherein the first end portion includes a ring, wherein the second end portion includes a base resting on at least one of the two end caps;

a roll of material mounted onto the rod between the first end portion and the second end portion such that the roll of material is visible on the rod through the transparent portion; and each of the end caps is configured to removably attach to a first end and a second end of at least one of the containers.

18. The container system kit of claim 17, wherein each of the end caps is configured to removably attach to the first end and the second end of at least one of the containers via interrupted threading.

* * * * *